US006026905A

United States Patent [19]

Garcia-Soule

[11] Patent Number: 6,026,905

[45] Date of Patent: Feb. 22, 2000

[54] SUBSEA TEST TREE AND METHODS OF SERVICING A SUBTERRANEAN WELL

[75] Inventor: Virgilio Garcia-Soule, Irving, Tex.

[73] Assignee: Halliburton Energy Services, Inc., Dallas, Tex.

[21] Appl. No.: 09/044,748

[22] Filed: Mar. 19, 1998

[51] Int. Cl.[7] ..... E21B 7/12; E21B 34/04

[52] U.S. Cl. ..... 166/336; 166/363

[58] Field of Search ..... 166/336, 339, 166/363, 364, 368

[56] References Cited

U.S. PATENT DOCUMENTS 4,256,282 3/1981 Goldschild et al. ..... 251/58

4,658,904 4/1987 Doremus et al. ..... 166/336

5,771,974 6/1998 Stewart et al. ..... 166/336

*Primary Examiner*—Elieen Dunn Lillis

*Assistant Examiner*—Sunil Singh

*Attorney, Agent, or Firm*—Paul I. Herman; Marlin R. Smith

[57] ABSTRACT

A subsea test tree and associated methods of servicing a well provide enhanced safety in testing operations. In a described embodiment, a subsea test tree includes a latch head assembly, a valve assembly, and a ramlock assembly interconnected between the latch head assembly and the valve assembly. The valve assembly includes two safety valves, one of which is operable by displacing a piston within the latch head assembly. The other safety valve is operable by applying fluid pressure to a line connected to the latch head assembly.

31 Claims, 5 Drawing Sheets

SUBSEA TEST TREE AND METHODS OF SERVICING A SUBTERRANEAN WELL

BACKGROUND OF THE INVENTION

The present invention relates generally to equipment utilized in, and operations performed in conjunction with, subterranean wells and, in an embodiment described herein, more particularly provides a subsea test tree.

Blowout preventer (BOP) stacks used in drilling and completing offshore and other underwater wells have become increasingly compact. For example, it is no longer uncommon for a BOP stack to have only about four feet or less vertical space between multiple shear rams and multiple pipe rams. With a conventional subsea test tree positioned within such a compact BOP stack during drill stem testing, it may not be possible for each of the pipe rams and each of the shear rams to successfully close.

If one or more of the pipe rams is not permitted to successfully effect a seal on the subsea test tree, or on a tubular string in which it is interconnected, fluid communication may be allowed between an annulus above the pipe rams and an annulus below the pipe rams. If one or more of the shear rams is not permitted to successfully close and shear the subsea test tree, or a tubular member attached thereto, it may not be possible to completely shut in the well. Thus, it will be readily appreciated that it would be highly advantageous for a subsea test tree to permit closing of multiple pipe rams, and to permit closing of multiple shear rams, while the test tree is operatively positioned within a compact BOP stack.

In order to accomplish this result in a compact BOP stack, a portion of the subsea test tree should be configured and dimensioned appropriately to permit sealing engagement of pipe rams therewith. Another portion of the subsea test tree should be configured and dimensioned to enable it to be positioned axially between the pipe rams and the shear rams. When closed, the pipe rams could seal against the appropriately configured portion, and the shear rams could sever another tubular member, such as pipe, extending outwardly from the portion of the subsea test tree positioned between the pipe and shear rams.

From the foregoing, it can be seen that it would be quite desirable to provide a subsea test tree which is usable within a compact BOP stack, permits sealing closure of multiple pipe rams therewith, and which permits a portion thereof to be operatively positioned within the BOP stack axially between multiple pipe rams and multiple shear rams.

SUMMARY OF THE INVENTION

In carrying out the principles of the present invention, in accordance with an embodiment thereof, a subsea test tree is provided which includes a latch head assembly interconnected to a valve assembly via a ramlock assembly. The latch head assembly has a compact configuration which permits it to be positioned between multiple pipe rams and multiple shear rams of a compact BOP stack. The ramlock assembly permits sealing engagement therewith by multiple pipe rams. Methods of servicing wells are also provided by the principles of the present invention.

In one aspect of the present invention, the valve assembly includes multiple safety valves. The valves are independently operable, although fluid pressure in a line connected to the latch head assembly controls their actuation. In a described embodiment, a control line and a balance line extend through an outer tubular member of the ramlock assembly for use in selectively opening and closing one of the valves. Another of the valves is actuated by displacing a structure within the outer tubular member in response to application of fluid pressure to one or more of the lines.

In another aspect of the present invention, a piston is disposed within the latch head assembly. The piston displaces in response to fluid pressure applied to a line connected to the latch head assembly. Displacement of the piston causes displacement of a structure within the ramlock assembly. Displacement of the structure, in turn, causes one of the valves to actuate.

In yet another aspect of the present invention, the latch head assembly and valve assembly are axially spaced apart and interconnected by the ramlock assembly. The ramlock assembly includes an inner tubular member movably disposed within a pressure-bearing outer tubular member. Displacement of the inner tubular member in a first direction relative to the outer tubular member causes one of the valves to open, and displacement of the inner tubular member in a second direction opposite to the first direction causes the valve to close. The inner tubular member is biased in the second direction by a biasing member, and is releasably interconnected to a piston within the latch head assembly.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
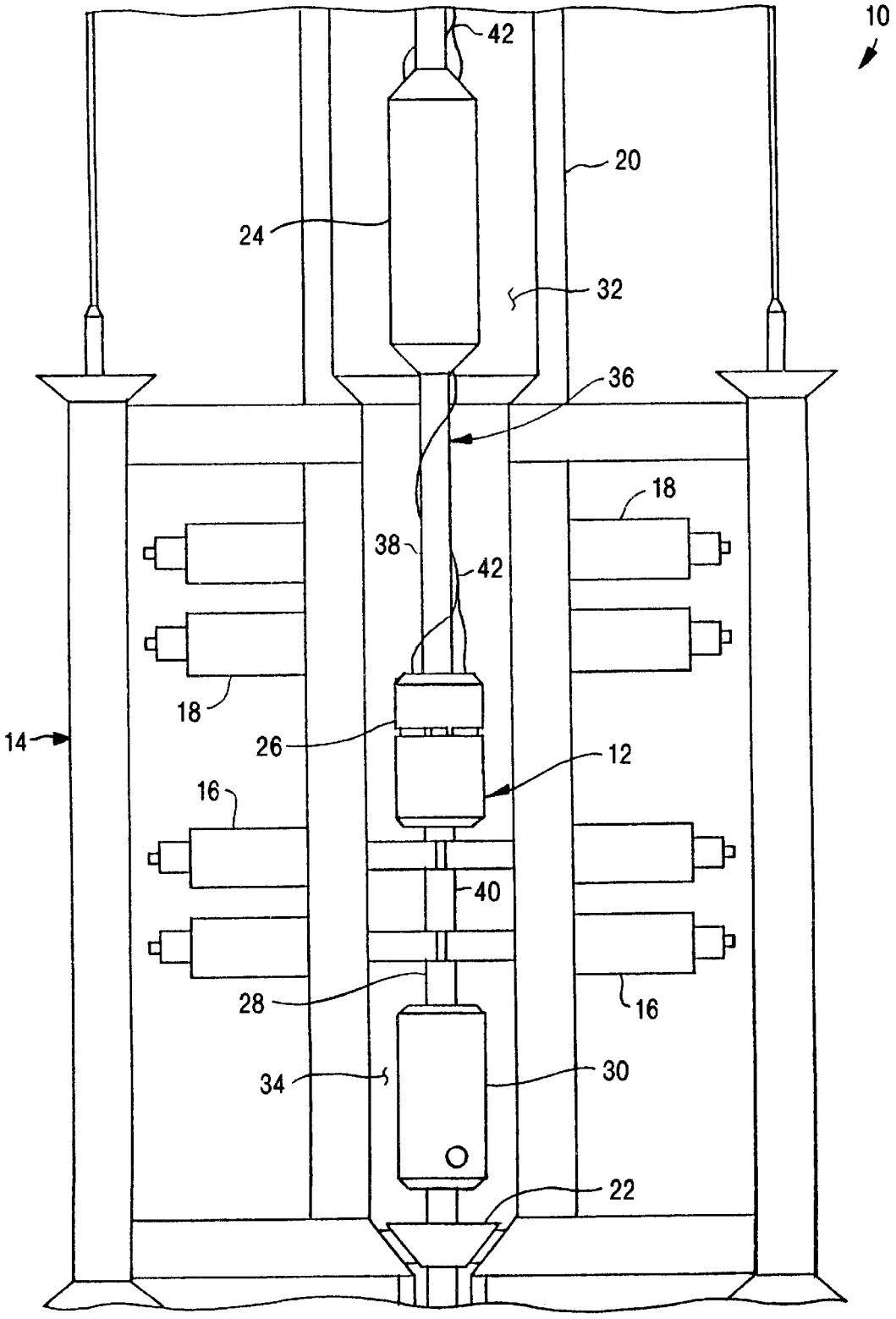
FIG. 1 is a schematic view of a method embodying principles of the present invention.

Representatively illustrated in FIG. 1 is a method of servicing a well 10 which embodies principles of the present invention. In the following description of the method 10 and other methods and apparatus described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

In the method 10, a subsea test tree 12 is positioned within a BOP stack 14 installed on an ocean floor, or otherwise underwater. The BOP stack 14 includes two pipe rams 16 and two shear rams 18, the rams being configured and controlled according to conventional practice. As representatively depicted, the BOP stack 14 is a compact BOP stack having multiple pipe and shear rams 16, 18, but it is to be clearly understood that a method incorporating principles of the present invention may be performed in other types of BOP stacks and in BOP stacks having greater or fewer numbers of pipe and shear rams.

The subsea test tree 12 is lowered into the BOP stack 14 through a tubular riser 20 extending upwardly therefrom. A fluted wedge 22 attached below the subsea test tree 12 permits the test tree to be accurately positioned within the BOP stack 14. A retainer valve 24 attached above the subsea test tree 12 may remain within the riser 20 when the test tree is positioned within the BOP stack 14 as shown in FIG. 1.

The subsea test tree 12 includes a latch head assembly 26, a ramlock assembly 28 and a valve assembly 30. The ramlock assembly 28 is interconnected axially between the latch head assembly 26 and the valve assembly 30 and axially separates one from the other. As used herein, the term "ramlock assembly" is used to indicate one or more members which are configured in such a way as to permit sealing engagement with conventional pipe rams. In FIG. 1, the ramlock assembly 28 is shown in sealing engagement with both of the pipe rams 16, the pipe rams having been previously actuated to extend inwardly and engage the ramlock assembly. Note that the representatively illustrated latch head assembly 26 and valve assembly 30 have diameters which are greater than that which may be sealingly engaged by conventional pipe rams, therefore, the ramlock assembly 28 provides for sealing engagement of the pipe rams 16 between the latch head and valve assemblies.

The valve assembly 30 is positioned between the pipe rams 16 and the wedge 22. Thus, when the pipe rams 16 are closed about the ramlock assembly 28, the valve assembly 30 is isolated from an annulus 32 above the pipe rams. 1he pipe rams 16 isolate the annulus 32 from an annulus 34 below the pipe rams and surrounding the valve assembly 30.

As used herein, the term "valve assembly" is used to indicate an assembly including one or more valves which are operative to selectively permit and prevent fluid flow through a flow passage formed through the valve assembly. The valve assembly 30 representatively illustrated in FIG. 1 includes two safety valves (not visible in FIG. 1), which are operative to control fluid flow through a tubular string 36. The retainer 24, latch head assembly 26, ramlock assembly 28 and the valve assembly 30 are all parts of the tubular string 36. In other words, the tubular string 36 has a flow passage formed therethrough, and the valves in the valve assembly 30 may be actuated to permit or prevent fluid flow through the flow passage. However, it is to be clearly understood that it is not necessary for the valve assembly 30 to include multiple valves, or for the valves to be safety valves, in keeping with the principles of the present invention.

As used herein, the term "latch head assembly" is used to indicate one or more members which permit decoupling of one portion of a tubular string from another portion thereof. For example, in the representatively illustrated test tree 12, the latch head assembly 26 may be actuated to decouple an upper portion 38 of the tubular string 36 from a lower portion 40 of the tubular string. Thus, in the event of an emergency, the pipe rams 16 may be closed on the ramlock assembly 28, the valves in the valve assembly 30 may be closed, and the upper portion 38 of the tubular string 36 may be retrieved, or otherwise displaced away from the lower portion 40. Closure of the pipe rams 16 on the ramlock assembly 28 and closure of the valves in the valve assembly 30 isolates the well therebelow from fluid communication with the riser 20.

If desired, the shear rams 18 may be actuated to shear the upper portion 38 of the tubular string 36 above the latch head assembly 26. The upper portion 38 may be sheared at a tubular handling sub attached above the latch head assembly 26. For this reason, the latch head assembly 26 is positioned between the shear rams 18 and the pipe rams 16 in the method 10. In this manner, redundancy is preserved and safety is, therefore, enhanced in that two shear rams 18 are usable above the latch head assembly 26 and two pipe rams 16 are usable below the latch head assembly in the compact BOP stack 14.

Actuation of the retainer 24, latch head assembly 26 and valve assembly 30 is controlled via lines 42. In the representatively illustrated embodiment shown in FIG. 1, the lines 42 are hydraulic lines which extend to the earth's surface and are used for delivering pressurized fluid to the subsea test tree 12 and retainer 24. However, it is to be clearly understood that the lines 42 could be one or more electrical lines, and that the subsea test tree 12 and/or retainer 24 could be electrically actuated, the lines could be replaced by one or more telemetry devices, the lines could extend to other locations in the well, etc., without departing from the principles of the present invention.

Referring additionally now to FIGS. 2A–2D, a subsea test tree 50 which may be used for the subsea test tree 12 in the method 10, and which embodies principles of the present invention is representatively illustrated. The subsea test tree 50 is shown in cross-section in FIGS. 2A–2D, with the left side of each of the drawings showing the subsea test tree wherein a valve assembly 52 thereof is open and a latch head assembly 54 thereof is maintained latched, and with the right side of each of the drawings showing the subsea test tree wherein the valve assembly is closed and the latch head assembly is permitted to decouple.

At an upper end of the latch head assembly 54, an upper sub 56 is threadedly and sealingly installed in the latch head assembly. The upper sub 56 may be provided with additional threads and seals, etc. at an upper end thereof in a conventional manner for attachment of the subsea test tree 50 into a tubular string, such as the tubular string 36 shown in FIG. 1. At a lower end of the valve assembly 52, a lower sub 58 is threadedly and sealingly installed in the valve assembly. The lower sub 58 is also provided with threads and a seal for interconnection to tubular members therebelow, such as the remainder of the lower portion 40 of the tubular string 36 shown in FIG. 1. Thus, the subsea test tree 50 may be interconnected in the tubular string 36 as parts of the upper and lower portions 38, 40 thereof, in a manner similar to that in which the subsea test tree 12 is interconnected in the method 10. However, it is to be clearly understood that the subsea test tree 50 may be otherwise interconnected in a tubular string and may be utilized in other methods, without departing from the principles of the present invention.

Lines, such as lines 42 shown in FIG. 1, may be connected to the subsea test tree 50 at ports 60, 62. As representatively illustrated in FIG. 2A, only two of the ports 60, 62 are visible, but it is to be understood that other ports are provided. The port 60 is for connection of a control line, port 62 is for connection of a balance line, and other ports are provided for connection of a latch line and an injection line or alternate control line for a subsurface safety valve. Of course, other ports, lines, and other numbers and combinations of lines and ports may be utilized without departing from the principles of the present invention.

From port 60, a control line passage 64 is formed in the latch head assembly 54 and extends downwardly therethrough. The control line passage 64 is in fluid communication with an annular piston 66 axially reciprocably and sealingly received within the latch head assembly 54. Fluid pressure in the control line passage 64 acts to bias the piston 66 downward against an upwardly biasing force exerted by a bias member or spring 68.

From port 62, a balance line passage 70 is formed in the latch head assembly 54 and extends downwardly therethrough, in a manner similar to the control line passage 64. The balance line passage 70 is in fluid communication with the piston 66 as well, however, fluid pressure in the balance line passage acts to bias the piston upward in concert with the upwardly biasing force of the spring 68. In operation, fluid in the balance line passage 70 is used to balance hydrostatic pressure in the control line passage 64, and pressure may be applied to the balance line passage 70 if desired to aid the spring 68 in shifting the piston 66 upward.

Another piston 72 is axially reciprocably and sealingly disposed within the latch head assembly 54. The piston 72 is biased downwardly by a bias member or spring 74. At a lower end of the piston 72, an outer tapered surface 76 is formed on the piston and is utilized to outwardly retain a set of lugs or dogs 78 in engagement with an annular profile 80 formed internally on a portion of an outer housing 82 of the latch head assembly 54. Of course, other surfaces and otherwise-shaped surfaces may be used to maintain engagement of the lugs 78 in the profile 80.

Figure 2A:
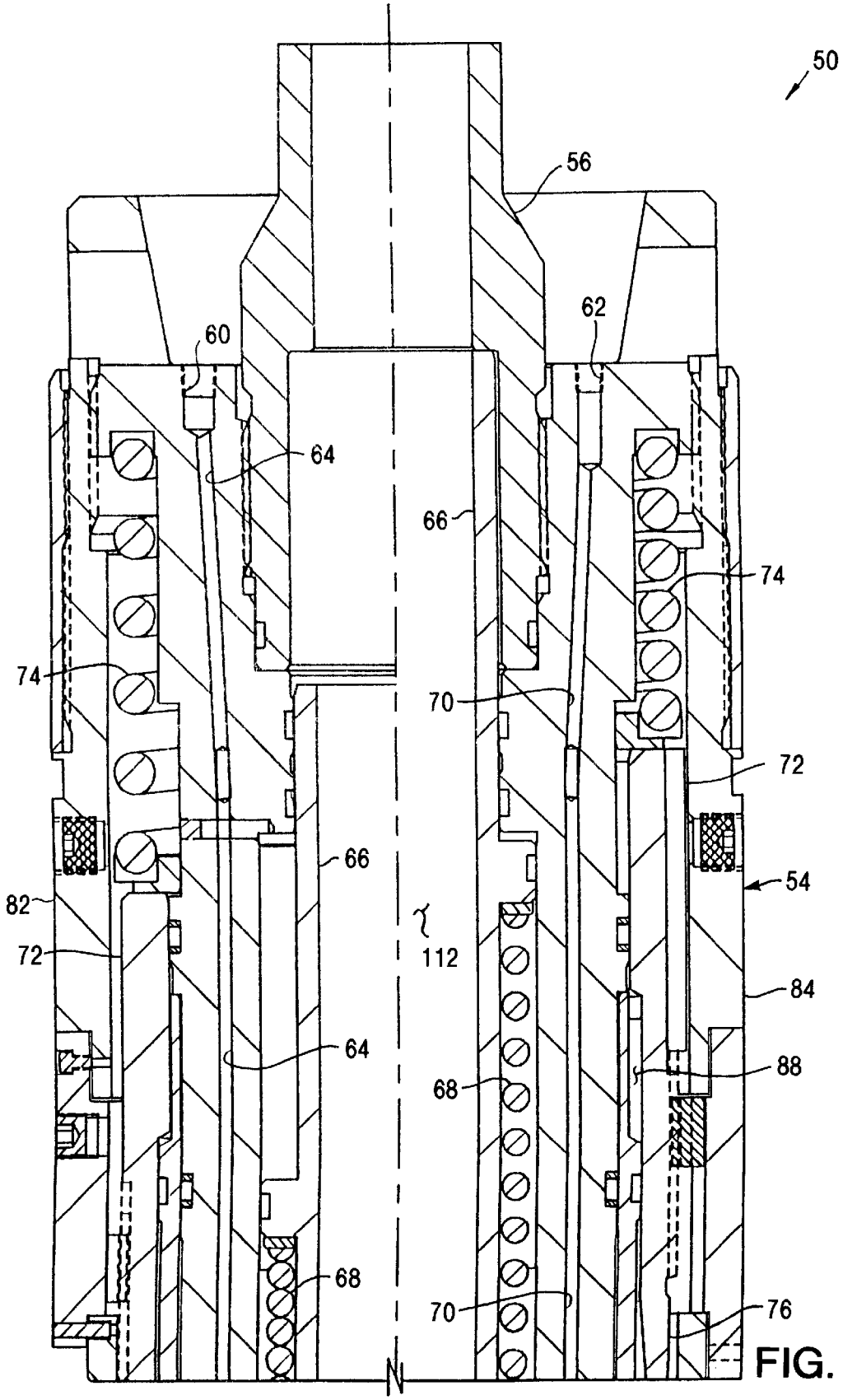
FIGS. 2A–2D are cross-sectional views of a subsea test tree embodying principles of the present invention.
Figure 2B:
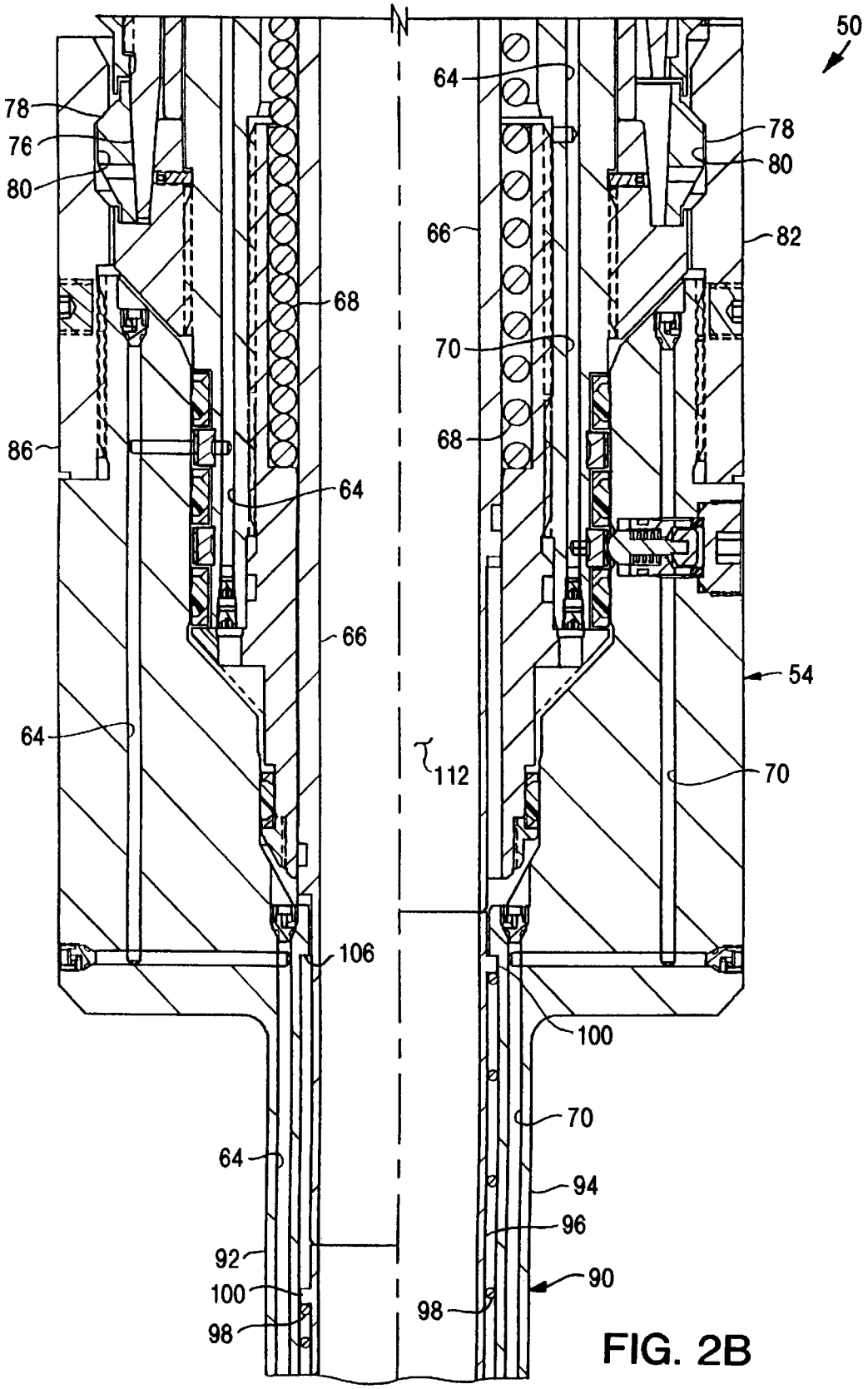
Figure 2C:
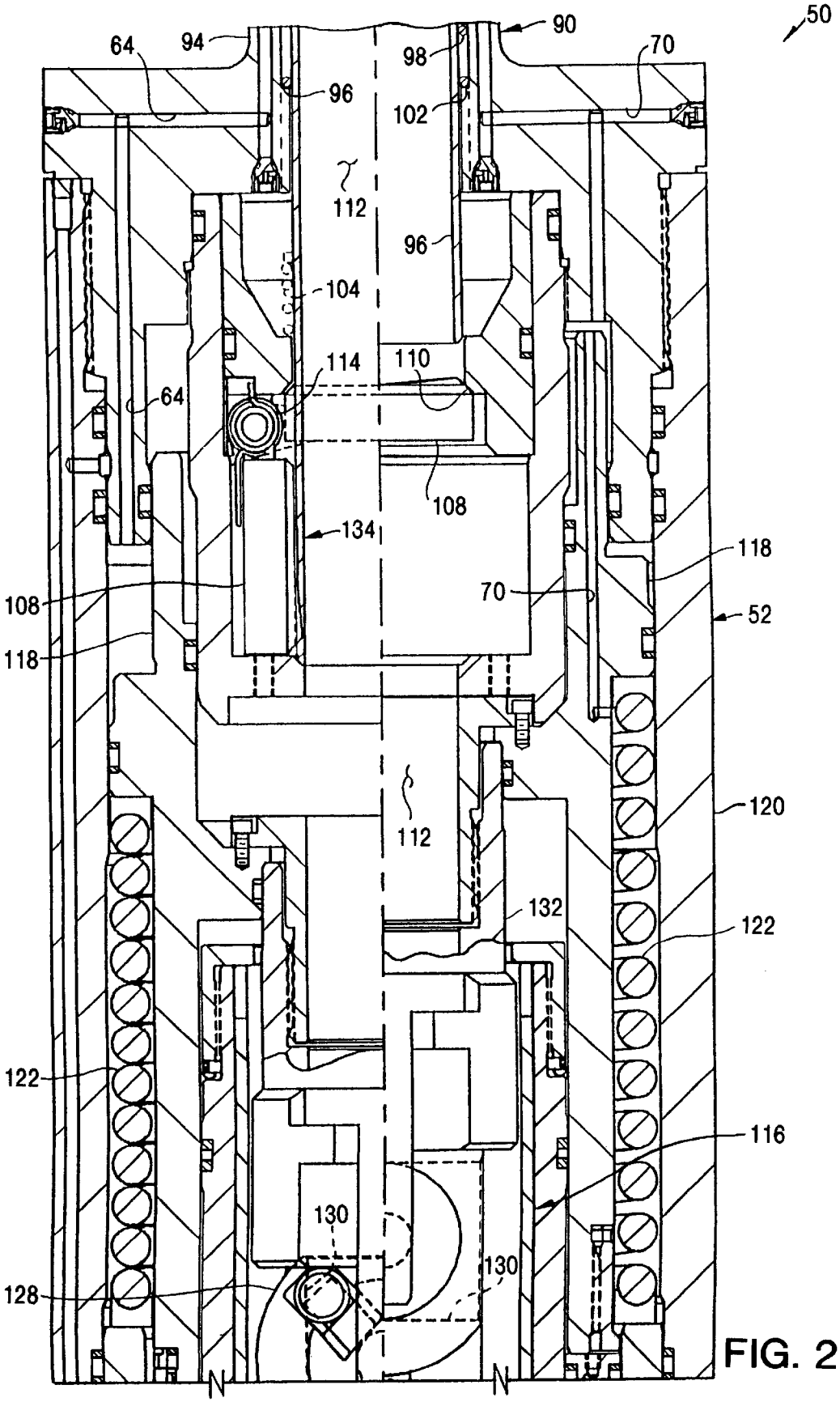
Figure 2D:
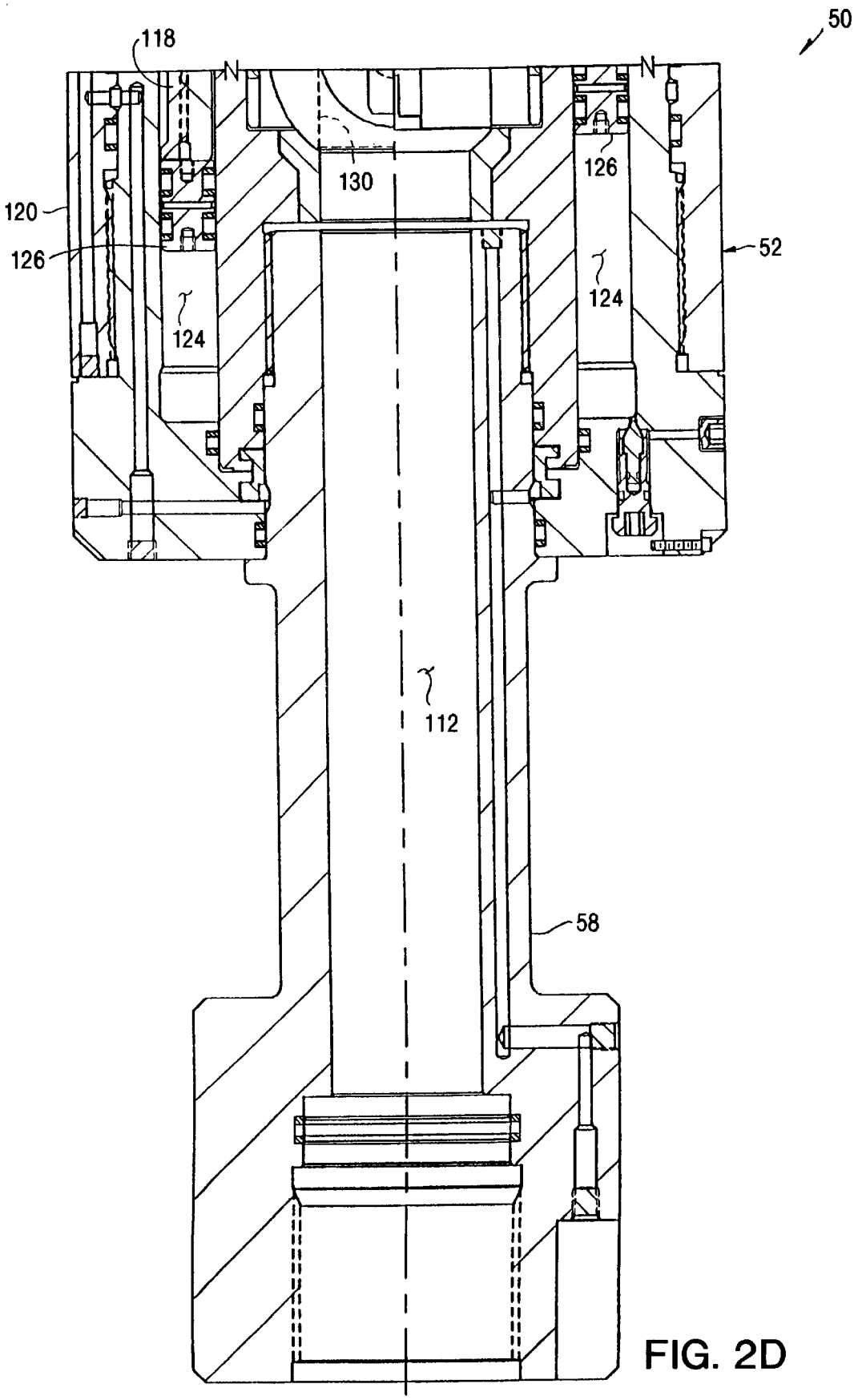

It will be readily appreciated that, with the piston 72 in its downwardly disposed position as shown on the left side of FIGS. 2A&2B, the lugs 78 are outwardly supported by the surface 76, but with the piston in its upwardly disposed position as shown on the right side of FIGS. 2A&2B, the lugs are not outwardly supported and may be disengaged from the profile 80. Thus, with the piston 72 in its downwardly disposed position, the latch head assembly 54 is latched, and with the piston in its upwardly disposed position, the latch head assembly is unlatched. When the latch head assembly 54 is unlatched, an upper portion 84 thereof may be upwardly displaced relative to a lower portion 86 thereof. When the latch head assembly 54 is latched, such axial separation is prevented.

To unlatch the latch head assembly 54, fluid pressure is applied to the piston 72 via an annular chamber 88, which is in fluid communication with the latch line port (not visible in FIG. 2A). Thus, fluid pressure is applied to the latch line port to upwardly displace the piston 72 against the downwardly biasing force exerted by the spring 74 in order to permit the lugs 78 to disengage the profile 80 and thereby permit relative axial displacement between the upper and lower portions 84, 86 of the latch head assembly 54.

A ramlock assembly 90 is interconnected between the latch head assembly 54 and the valve assembly 52. The ramlock assembly 90 axially separates the latch head assembly 54 from the valve assembly 52 and provides an appropriately sized and configured outer side surface 92, which may be sealingly engaged by a conventional pipe ram. The depicted outer side surface 92 is generally cylindrical in shape, but it is to be understood that otherwise-shaped surfaces may be utilized without departing from the principles of the present invention.

In the representatively illustrated embodiment, an upper end of the ramlock assembly 90 is integrally formed with, and forms a part of, the lower portion 86 of the latch head assembly 54. A lower end of the ramlock assembly 90 is integrally formed with, and forms a part of, the valve assembly 52. However, it is to be clearly understood that the ramlock assembly 90 may be separately formed and otherwise attached between the valve assembly 52 and latch head assembly 54, without departing from the principles of the present invention.

The ramlock assembly 90 includes an outer tubular member 94, which has the outer surface 92 formed thereon, and an inner tubular member 96. The inner tubular member 96 is axially reciprocably disposed within the outer tubular member 94 and is biased upwardly by a bias member or spring 98. The spring 98 is disposed radially between the inner and outer tubular members 96, 94.

The control line passage 64 extends downwardly through a sidewall of the outer member 94. Similarly, the balance line passage 70 is formed axially through the outer member 94 sidewall. In this manner, fluid pressure in the control line and balance line passages 64, 70 is available for use in the valve assembly 52, as is described in more detail below.

The spring 98 is axially compressed between a radially enlarged shoulder 100 formed externally on the inner member % and a shoulder 102 formed internally on the outer member 94 within the valve assembly 52. Of course, the spring 98 could easily be otherwise positioned. For example, in FIG. 2C, a spring 104 is shown in dashed lines, indicating that the spring could be positioned entirely within the valve assembly 52, instead of in the ramlock assembly 90.

When the inner member % is in its upwardly disposed position, it abuts a shoulder 106 internally formed on the outer member 94 within the latch head assembly 54. The inner member 96 also abuts a lower end of the piston 66. As the piston 66 is displaced between its upwardly and downwardly disposed positions, the inner member 96 is thereby correspondingly displaced between its upwardly and downwardly disposed positions. The spring 98 maintains engagement between the piston 66 and the inner member 96 between the upwardly and downwardly disposed positions, and ensures that when the piston 66 is displaced upwardly, the inner member 96 also displaces upwardly therewith.

However, note that the engagement between the piston 66 and the inner member 96 is releasable. When the latch head assembly 54 is unlatched, the piston 66 may be displaced upwardly with the remainder of the upper portion 84 away from the lower portion 86. Thus, the piston 66 and the inner member 96 may be axially separated.

When the latch head assembly 54 is unlatched, as shown on the right side of FIG. 2B, the piston 66 is in its upwardly disposed position and does not extend significantly outward from the upper portion 84. Likewise, the inner member 96 is recessed within the lower portion 86, the shoulder 106 preventing further upward displacement of the inner member. Thus, the piston 66 and inner member 96 are protected from damage during the unlatching process and displacement of the upper portion 84 away from the lower portion 86.

When the inner member 96 is displaced downwardly by the piston 66 in response to fluid pressure in the control line passage 64, a lower end of the inner member contacts and pivots a generally disc-shaped flapper 108 away from a circumferential seat 110. When the inner member 96 is in its upwardly disposed position, the flapper 108 is permitted to sealingly engage the seat 110, thereby preventing fluid flow through an inner flow passage 112 formed axially through the subsea test tree 50. A bias member or spring 114 biases the flapper 108 toward its closed position. Thus, as shown on the left side of FIG. 2C, the inner member 96 is in its downwardly disposed position and the flapper 108 is in its open position, and on the right side of FIG. 2C, the inner member is in its upwardly disposed position and the flapper is in its closed position.

The flapper 108, seat 110, spring 114 and lower end of the inner member 96 together constitute a flapper valve 134 in the valve assembly 52. The flapper valve 134 is in many respects similar to flapper valves well known to those skilled in the art and utilized in conventional safety valves. Another type of safety valve is disposed within the valve assembly 52—a ball valve 116. Thus, the valve assembly 52 uniquely has two valves disposed therein, each of the valves being safety valves. It is, however, to be understood that other numbers of valves and other types of valves may be disposed within the valve assembly 52 in keeping with the principles of the present invention.

The ball valve 116 includes an annular piston 118 axially reciprocably and sealingly disposed within an outer housing 120 of the valve assembly 52. The piston 118 is upwardly biased by a bias member or spring 122 and by a pressurized gas chamber 124. Pressurized gas (preferably, Nitrogen) in the chamber 124 exerts an upwardly biasing force on an annular floating piston 126 which, in turn, transmits the upwardly directed force to a lower end of the piston 118.

To downwardly displace the piston 118, fluid pressure is applied to the control line passage 64, which is in fluid communication with the piston 118. When the piston 118 is in its downwardly displaced position, as shown on the left side of FIG. 2C, a ball 128 of the ball valve 116 has an opening 130 aligned with the flow passage 112, permitting fluid flow therethrough. When the piston 118 is in its upwardly displaced position, as shown on the right side of FIG. 2C, the ball 128 is in its closed position, with flow through the opening 130 being prevented.

Axial displacement of the piston 118 is translated into rotation of the ball 128 by an actuator mechanism 132 of the type well known to those skilled in the art. The actuator mechanism 132 may be similar to those used in conventional ball valves. However, it is to be understood that other actuator mechanisms and other types of actuators may be used, without departing from the principles of the present invention.

When it is desired to open the ball valve 116, sufficient fluid pressure is applied to the control line passage 64 to displace the piston 118 downward against the combined upwardly biasing forces due to fluid pressure in the balance line passage 70, the spring 122 and the compressed gas in the chamber 124. When it is desired to close the ball valve 116, fluid pressure is released from the control line passage 64, permitting the piston 118 to displace upwardly. If desired, fluid pressure may be applied to the balance line passage 70 to assist in displacing the piston 118 upwardly.

Thus, it may be seen that the subsea test tree 50 is uniquely configured so that it may be positioned in the compact BOP stack 14, with the latch head assembly 54 between the multiple shear rams 18 and the multiple pipe rams 16, thereby permitting redundancy in each set of rams for enhanced safety, and with the ramlock assembly 90 aligned with the pipe rams, thereby permitting multiple pipe rams to sealingly engage the ramlock assembly, and with the valve assembly 52 positioned below the pipe rams, the valve assembly including multiple independently operable safety valves 116, 134. In another unique feature of the present invention, the flapper valve 134 is operated by displacing the inner member 96 in response to displacement of the piston 66 disposed within the latch head assembly 54. The piston 66 is releasably engaged with the inner member 96, permitting the latch head assembly 54 to be unlatched and the upper portion 84 to be displaced away from the lower portion 86, without causing damage to either the piston or the inner member.

Of course, many modifications, additions, substitutions, deletions and other changes may be made to the method 10 and subsea test tree 50, which changes would be obvious to one skilled in the art. For example, each of the springs described above could be replaced with another type of bias member, such as a compressed gas chamber. Other changes may be made without departing from the principles of the present invention. Accordingly, the foregoing detailed description is to be clearly understood as being given by way of illustration and example only, the spirit and scope of the present invention being limited solely by the appended claims.

What is claimed is:

1. A subsea test tree, comprising:

a valve assembly including first and second safety valves; and an elongated first tubular member interconnected between and axially separating a latch head assembly and the valve assembly, the elongated first tubular member being positionable between and sealingly engageable by pipe rams disposed between the latch head assembly and the valve assembly, the first safety valve being actuatable by displacing a structure disposed at least partially within the first tubular member and extending between the latch head assembly and the valve assembly.

2. The subsea test tree according to claim 1, wherein the first and second safety valves are disposed within a housing separate from the latch head assembly.

3. The subsea test tree according to claim 1, wherein the first safety valve is a flapper valve.

4. The subsea test tree according to claim 1, wherein the second safety valve is a ball valve.

5. The subsea test tree according to claim 1, wherein a piston is reciprocably disposed within the latch head assembly, the piston being selectively positionable in first and second positions in response to fluid pressure applied to the latch head assembly.

6. The subsea test tree according to claim 5, wherein the first safety valve is interconnected to the piston, the first safety valve opening in response to the piston being displaced to the first position, and the first safety valve closing in response to the piston being displaced to the second position.

7. The subsea test tree according to claim 5, wherein the structure interconnects the piston to the first safety valve.

8. The subsea test tree according to claim 7, wherein the structure is a second tubular member movably received within the first tubular member.

9. The subsea test tree according to claim 7, further comprising a bias member urging the structure toward a position thereof in which the first safety valve is permitted to close.

10. The subsea test tree according to claim 7, wherein the structure is releasably engaged with the piston.

11. The subsea test tree according to claim 10, wherein the structure is disengaged from the piston when the latch head assembly is unlatched.

12. A subsea test tree for use in a blowout preventer stack including at least one pipe ram, the test tree comprising:

a ramlock assembly sealingly engageable by the pipe ram, the ramlock assembly including an outer pressure-bearing tubular member, and an inner tubular member movably disposed within a portion of the outer tubular member, the ramlock assembly being interconnected between and axially separating a latch head assembly and a valve assembly.

13. The subsea test tree according to claim 12, wherein the inner tubular member is movable in response to displacement of a piston disposed within the latch head assembly.

14. The subsea test tree according to claim 12, wherein the inner tubular member is movable against a biasing force exerted by a bias member.

15. The subsea test tree according to claim 14, wherein the bias member is disposed radially between the inner and outer tubular members.

16. The subsea test tree according to claim 12, wherein the ramlock assembly further includes a fluid pressure line formed axially through a sidewall of the outer tubular member.

17. The subsea test tree according to claim 12 wherein the valve assembly includes first and second safety valves.

18. The subsea test tree according to claim 17, wherein each of the first and second safety valves is operable by application of fluid pressure to a line extending from the latch head assembly to the valve assembly.

19. The subsea test tree according to claim 18, wherein a piston of the latch head assembly is engageable with the inner tubular member in response to fluid pressure in the line.

20. The subsea test tree according to claim 19, wherein the inner tubular member is releasably engageable with the piston.

21. The subsea test tree according to claim 19, wherein the inner tubular member is displaceable in response to displacement of the piston.

22. The subsea test tree according to claim 19, wherein the first safety valve is operable in response to displacement of the inner tubular member.

23. A method of servicing a subterranean well having a blowout preventer stack including at least one pipe ram and at least one shear ram, the method comprising the steps of:

interconnecting a ramlock assembly between a valve assembly and a latch head assembly, the valve assembly including at least two safety valves;

positioning the latch head assembly within the blowout preventer stack axially between the pipe ram and the shear ram;

positioning the ramlock assembly opposite the pipe ram within the within the blowout preventer stack; and actuating one of the valves by displacing a structure disposed within the ramlock assembly and extending between the latch head assembly and the valve assembly.

24. The method according to claim 23, wherein the blowout preventer stack includes multiple pipe rams and multiple shear rams, wherein the latch head assembly positioning step further comprises positioning the latch head assembly between the multiple pipe rams and the multiple shear rams, and wherein the ramlock assembly positioning step further comprises positioning the ramlock assembly opposite the multiple pipe rams.

25. The method according to claim 23, wherein the actuating step further comprises displacing the structure relative to the one of the valves.

26. A method of servicing a subterranean well having a blowout preventer stack including at least one pipe ram and at least one shear ram, the method comprising the steps of:

interconnecting a ramlock assembly between a valve assembly and a latch head assembly, the valve assembly including at least two safety valves;

positioning the latch head assembly within the blowout preventer stack axially between the pipe ram and the shear ram;

positioning the ramlock assembly opposite the pipe ram within the blowout preventer stack;

actuating one of the valves by displacing a structure within the ramlock assembly;

applying fluid pressure to a line connected to the latch head assembly; and displacing a piston in response to the fluid pressure application, the step of actuating one of the valves being performed in response to the piston displacement.

27. The method according to claim 26, further comprising the step of actuating the other of the valves in response to the fluid pressure application.

28. A method of servicing a subterranean well, the method comprising the steps of:

positioning first and second safety valves within a valve assembly having an axial flow passage formed therethrough, each of the first and second safety valves being actuatable to selectively permit and prevent fluid flow through the flow passage;

attaching the valve assembly to a latch head assembly via an elongated outer tubular member extending therebetween, the outer tubular member axially separating the valve assembly from the latch head assembly and being sealingly engageable by a pipe ram;

actuating the first safety valve by displacing a structure within the outer tubular member in response to displacement of a piston within the latch head assembly; and actuating the second safety valve by applying fluid pressure to a line connected to the latch head assembly.

29. The method according to claim 28, wherein the first safety valve actuating step further comprises displacing the piston within the latch head assembly in response to the application of fluid pressure to the line.

30. The method according to claim 28, further comprising the step of biasing the structure in a first direction.

31. The method according to claim 30, wherein the first safety valve actuating step further comprises displacing the structure in a second direction opposite to the first direction in response to the fluid pressure applied to the line.

* * * * *